US007080428B2

(12) United States Patent
Hyde

(10) Patent No.: US 7,080,428 B2
(45) Date of Patent: Jul. 25, 2006

(54) DETACHABLE HINGE DEVICE

(76) Inventor: Warren L. Hyde, 363 Deerfield Rd., Candia, NH (US) 03034

( * ) Notice: Subject to any disclaimer, the term of this patent is extended or adjusted under 35 U.S.C. 154(b) by 0 days.

(21) Appl. No.: 10/908,966

(22) Filed: Jun. 2, 2005

(65) Prior Publication Data

US 2005/0283948 A1 Dec. 29, 2005

Related U.S. Application Data

(60) Provisional application No. 60/576,449, filed on Jun. 3, 2004.

(51) Int. Cl.
*E05D 7/10* (2006.01)

(52) U.S. Cl. ..... 16/265; 16/266; 16/231; 16/254

(58) Field of Classification Search ..... 16/265, 16/231–233, 254, 257, 258, 266, 272, 348, 16/350, 357, 361–363; 296/193.11; 180/69.21, 180/274; 292/100, 108, 194, 200, 210, 304, 292/DIG. 42

See application file for complete search history.

(56) References Cited

U.S. PATENT DOCUMENTS

| | | | | |
|---|---|---|---|---|
| 4,437,529 | A | 3/1984 | Fralish | |
| 4,929,007 | A | 5/1990 | Bartczak et al. | |
| 5,118,146 | A * | 6/1992 | Watanuki | 292/216 |
| 5,174,617 | A * | 12/1992 | Huber et al. | 292/128 |
| 5,339,494 | A * | 8/1994 | Esau et al. | 16/294 |
| 5,474,360 | A * | 12/1995 | Chang | 297/367 |
| 6,003,204 | A | 12/1999 | Roach et al. | |
| 6,052,870 | A * | 4/2000 | Hagenlocher et al. | 16/347 |
| 6,123,379 | A * | 9/2000 | Yamada et al. | 296/65.03 |
| 6,167,977 | B1 * | 1/2001 | Adamson et al. | 180/69.2 |
| 6,554,093 | B1 * | 4/2003 | Sasaki et al. | 180/274 |
| 2005/0257980 | A1 * | 11/2005 | Green et al. | 180/274 |

* cited by examiner

*Primary Examiner*—Chuck Y. Mah
*Assistant Examiner*—Mark T. Vogelbacker
(74) *Attorney, Agent, or Firm*—Robert B. Deleault; Mesmer & Deleault, PLLC

(57) ABSTRACT

A hinge device having a way to detach one hinge member from another includes a fender mounting plate with a pivot pin secured thereto, a hood mounting plate having a pivot pin engaging slot, an elongated pawl having a latch plate engaging end, the pawl secured to the hood mounting plate, a latch plate rotatably secured to the hood mounting plate in a spaced relationship with the elongated pawl where the latch plate has a pawl engaging slot shaped to engage the pawl latch plate engaging end, a pivot pin engaging slot shaped to engage the pivot pin, and a pawl unlock surface that contacts the latch plate engaging end when the elongated pawl is not engaged with the pawl engaging, whereby a user can detach one hinge member from another by withdrawing the elongated pawl, translating one hinge member in relation to the other, and thereby rotating the latch plate, which disengages the latch plate and hood mounting plate from the pivot pin and separates the hinge members.

18 Claims, 6 Drawing Sheets

DETACHABLE HINGE DEVICE

This application claims the benefit of U.S. Provisional Patent Application Ser. No. 60/576,449, filed Jun. 3, 2004.

BACKGROUND OF THE INVENTION

1. Field of the Invention

The invention relates to a hinge having means to detach one hinge member from another.

2. Description of the Related Art

Hinges are used on covers, doors, suitcases, vehicles, and the like, to provide a way to access an object without having to remove the cover, door, etc. Hinges come in a variety of designs and styles including door hinges, continuous hinges, internal and external hinges, and the like. Generally, hinges include two components with a pin or rod that connects the two hinge components together allowing the two hinge components to rotate relative to each other about the axis of the pin or rod. For example, to separate a door from its molding, the hinge pins must be removed in order to separate the two hinge components.

In another example, many automotive repairs require a mechanic to remove the hood of the car to gain access to the engine. Sometimes the engine must even be removed for service.

Removing and reinstalling the hood of a car has been a difficult procedure at best. Typically, the hood is bolted onto hinges, which in turn are bolted somewhere into the engine compartment. As soon the bolts are loosened, the hood tends to fall over. In practice, one or two mechanics were required to hold the hood up while a mechanic removes the bolts connecting the hood to the car. The most time consuming and difficult aspect is the time spent remounting the hood. It is difficult to hold the hood in place and get the bolts or mounting hardware started. There is also difficulty in aligning the hood to the body parts so as not to damage the hood or other parts, or paint, upon initial closure of the hood. Lastly, getting the final fit and alignment correct requires numerous iterations of adjustments and possibly shimming to obtain the proper fit. The result is that substantial mechanic time and expense is required to remove the hood.

Therefore, what is needed is a detachable hinge system that securely holds the door, cover, or vehicle hood when the hinge system is closed. What is also needed is a detachable hinge system that operates as a hinge when closed, but can be released when opened without removing any hinge bolts, hinge screws, or hinge pins. What is further needed is a detachable hinge system that can be released with one hand.

SUMMARY OF THE INVENTION

It is an object of the present invention to provide a detachable hinge system that securely holds the door, cover, or vehicle hood when the hinge system is closed. It is another object of the present invention to provide a detachable hinge system that operates as a hinge when closed, but can be released when opened without removing any hinge bolts, hinge screws, or hinge pins. It is a further object of the present invention to provide a detachable hinge system that can be released with one hand. It is still another object of the present invention to provide a detachable hinge system that allows the door, cover, or vehicle hood to be removed and reinstalled quickly.

The present invention achieves these and other objectives by providing in one embodiment a detachable hinge system that includes a hinge assembly having a hood mounting plate, an elongated pawl slideably secured to the hood mounting plate, a latch plate rotatably secured to a side of the hood mounting plate in a spaced relationship with the pawl, and a fender mounting plate having a pivot pin for receiving the latch plate and the hood mounting plate.

The elongated pawl has a latch plate engaging end. The latch plate has a pawl engaging slot shaped to receive the pawl latch plate engaging end of the elongated pawl, a pivot pin engaging slot shaped to engage the pivot pin of the fender mounting plate, and a pawl unlock surface that contacts the latch plate engaging end when the pawl is not engaged with the slot. When being installed, the pivot pin is moved into the pin engaging slot of the hood mounting plate and the latch plate simultaneously. The pivot pin is stopped by the end of the pivot pin engaging slot forcing the latch to rotate and causing the pawl to engage into the slot automatically by the expansion spring.

The present invention is a detachable hinge system that is easily separable. The detachable hinge of the present invention can be separated and reassembled quickly and easily without removing any hardware such as hinge bolts, hinge screws, hinge pins, and the like. The detachable hinge is released by a single lever (pawl) that is slidably fixed to one part of the hinge, thus, there are no parts to lose. The detachable hinge also includes a unique feature that does not require a user to reset the latch when reassembling the hinge. The present invention may be used as original equipment or as an aftermarket replacement kit.

It is noted that the present invention can be configured as either a right side or a left side mounting plates. The present invention can be used for cars, trucks, tractors, any vehicle, and any other application requiring a removable hinged member. These and other features and embodiments of the invention will be made clear in the following drawings, description, and claims.

DETAILED DESCRIPTION OF THE PREFERRED EMBODIMENT

Figure 1:
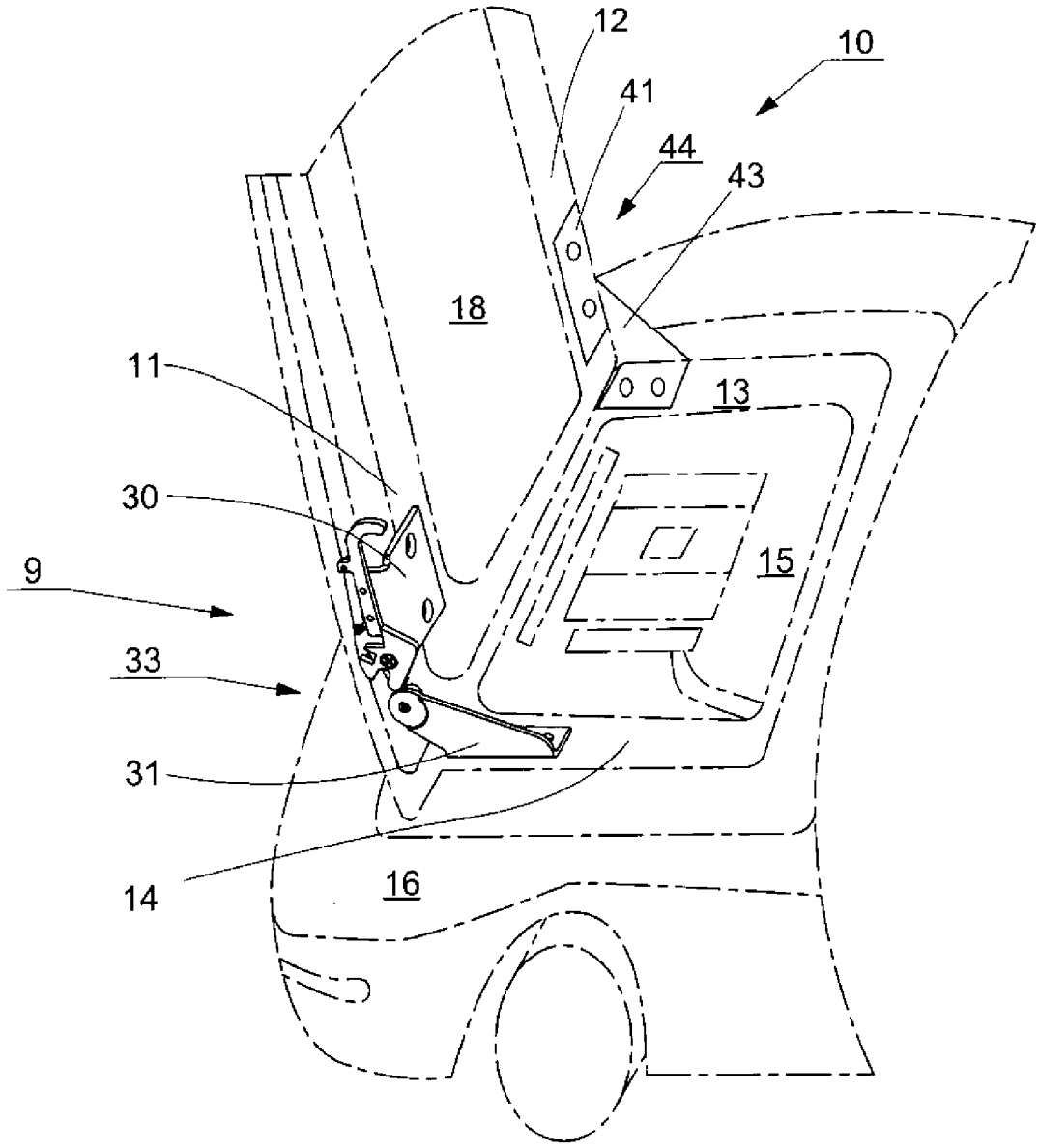
FIG. 1 is a perspective view of the detachable hood hinge system with an vehicle hood in the up position. The left side hinge is shown detached and right side is shown attached.

FIG. 1 shows a vehicle 10 with a hood 18 which when closed covers the engine compartment 15. The detachable hood mounting system 9 includes a left side hinge assembly 33 and a right side hinge assembly 44. Attaching the detachable hood mounting system 9 is accomplished as follows.

A left side fender mounting plate 31 is mounted to the auto fender 14 with standard mounting bolts. The left side hood mounting plate 30 is mounted to the left side hood 18 at 11 with standard mounting bolts.

The right side fender mounting plate 43 is mounted to the right fender at 13 with standard mounting bolts. The right side hood mounting plate 41 is mounted to the right side hood 18 at 12 with standard mounting bolts.

Attaching the hood 18 without removing the mounting bolts is accomplished with the detachable hinge system 9 using the following procedure.

Figure 5:
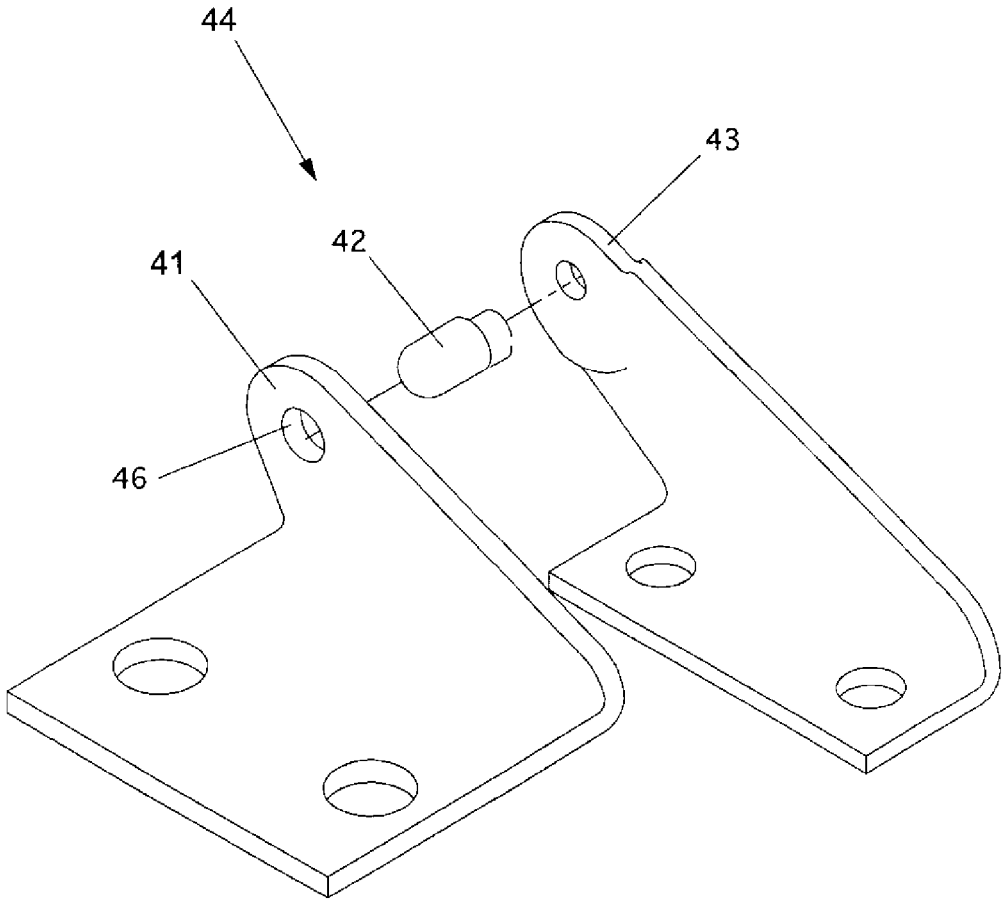
FIG. 5 is an exploded perspective view of the right side hinge assembly.

First the hood 18 is lowered into mounting position. Then, turning to FIG. 5, the right side hood mounting plate 41 is coupled to the right side fender mounting plate 43 by aligning the hole 46 to the pin 42 and sliding the hood 18 laterally to the right.

Figure 2:
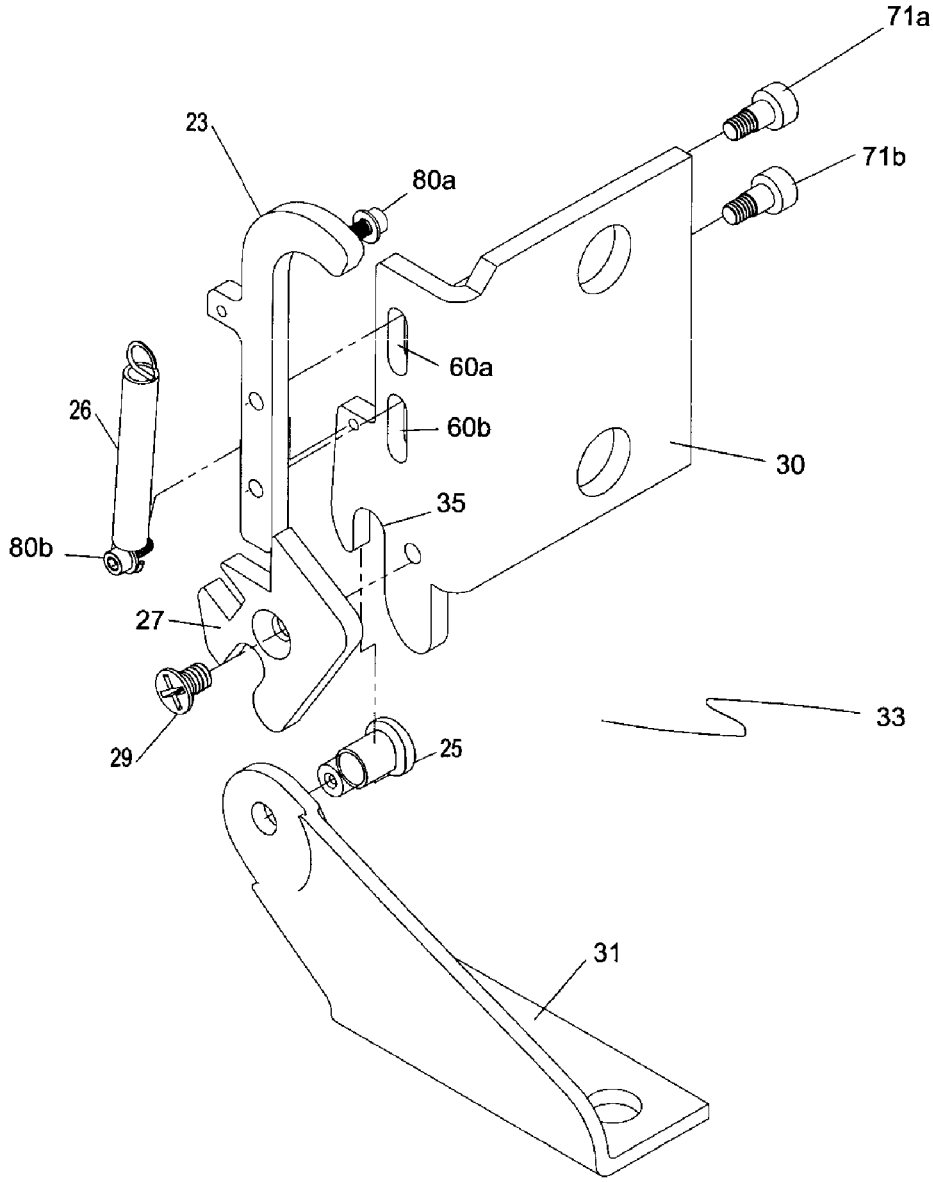
FIG. 2 is an exploded perspective view of the left side hinge assembly.

Once the right side is in place, the mechanic can then secure the left side. Turn to FIGS. 2–4 for the left side, the left side hinge assembly 33 includes several components. Left side hood mounting plate 30 and left side fender mounting plate 31 are secured to the car. A latch plate 27 is rotatably secured to the left hood mounting plate 30 with a screw 29. A left side mounting plate slot 35 is manually aligned with the left striker pivot pin 25 secured to the left side fender mounting plate 31. Then the left side hood mounting plate 30 and latch plate 27 are pushed manually downward onto the striker pivot pin 25. The latch plate 27 has a pivot pin engaging slot 56 to accept and engage the pivot pin 25. The force from the pivot pin 25 on to the latch plate 27 causes the latch plate 27 to rotate on the screw 29. As the latch plate 27 rotates to the locked position relative to the mounting plate slot 35, a pawl 23 is pulled into place automatically in a slot 55 by a return/extension spring 26. When the pawl 23 is forced automatically into the slot 55 by extension spring 26 (which is preloaded in the unlatched position) of the latch plate 27, the pieces of the left side assembly are latched together. The left side of the hood 18 is attached when the assembly 33 is latched in a hinge closed position. The hood 18 can now be opened and closed as a normally hinged hood.

The hood can be removed from the automobile without removing any mounting bolts by unlatching and separating left side hinge assembly and sliding the hood to the left and detaching the right side hood mounting plate 41 from the right side fender mounting plate 43.

Figure 4:
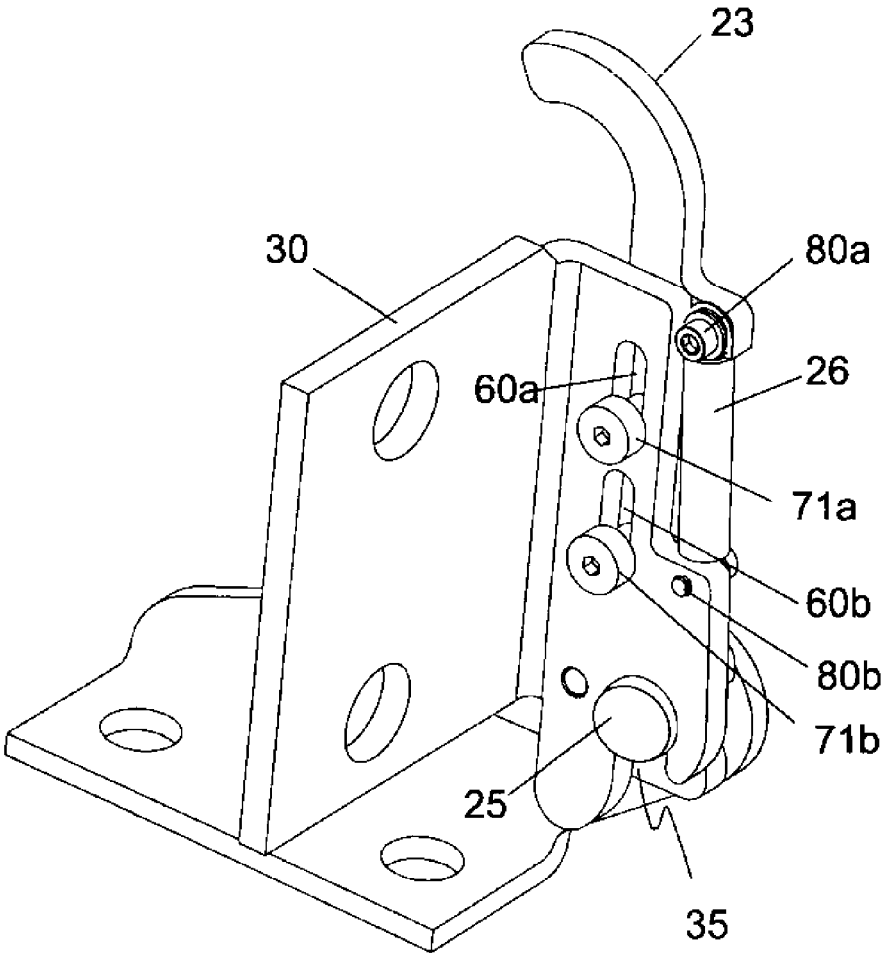
FIG. 4 a perspective view of the left side hinge assembly in the attached position from a different perspective from FIG. 2.

FIG. 4 shows the left side hinge assembly attached together and latched. pawl mounting screws 71*a*, 71*b* are completely forward in slots 60*a*, 60*b*, respectively, in an engaged and latched position.

Removal of the hood is accomplished by manually pulling back the pawl 23 using its handle 76 from the latch plate 27, allowing the left side hinge latch plate 27 to rotate on the screw 29. This releases the striker pivot pin 25 allowing the hood and fender mounting plates to be separated. Pawl 23 is attached to left side mounting plate 30 by pawl mounting screws 71*a*, 71*b* which are aided in movement by shoulder screws 70*a*, 70*b*. Slots 60*a*, 60*b* allow the pawl to slide to lock and unlock the latch plate 27.

Figure 3:
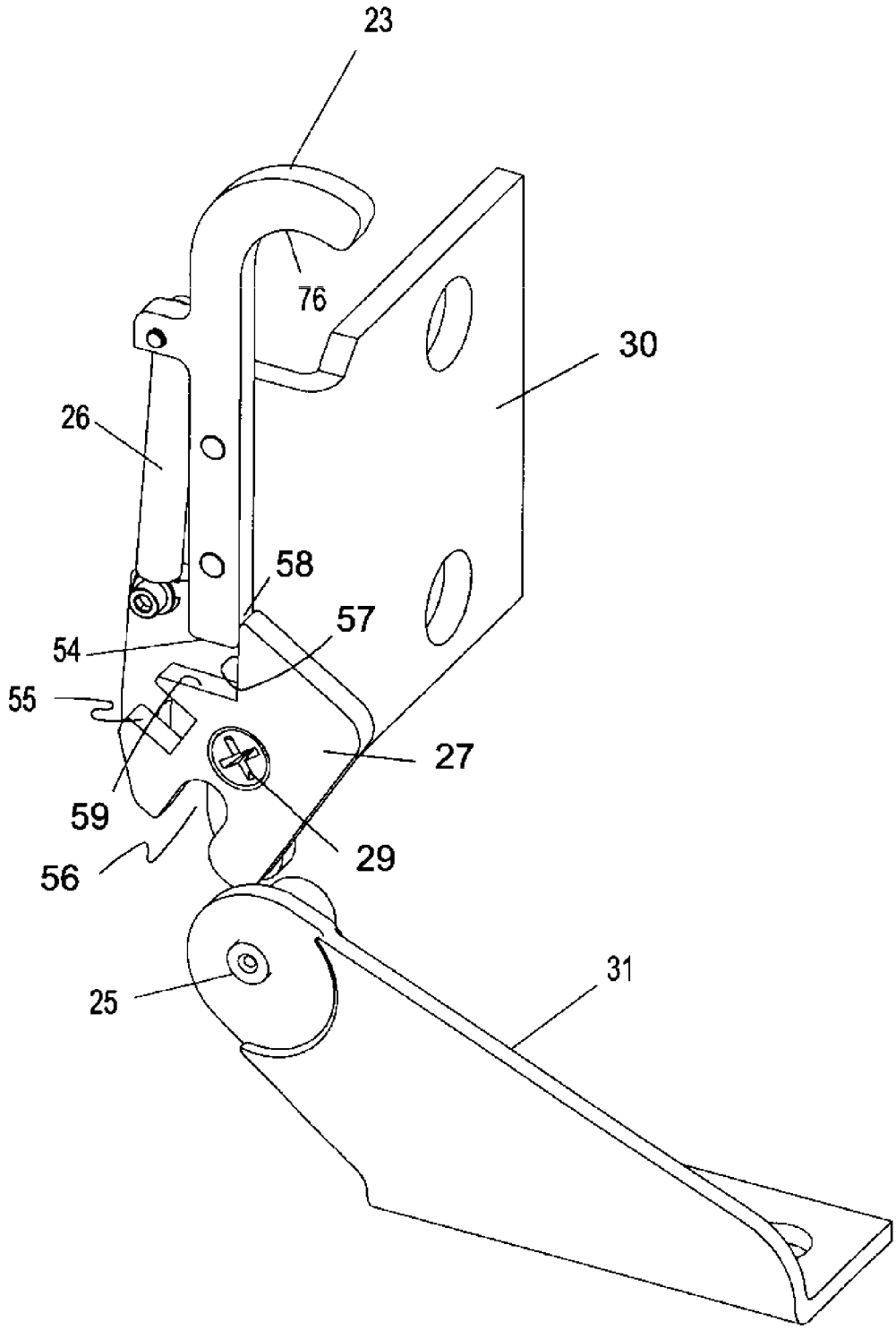
FIG. 3 is a perspective view of the left side hinge assembly in the detached position.

In the unlatched position, the left side latch plate 27 has rotated to stop 58, shown in FIG. 3, against pawl 23. The latch plate 27 is held in the open, i.e. unlatched, position by the pawl latch plate engaging end surface 54 contacting the pawl unlock surface 59 and holding the latch plate stop engaging surface 57 against stop 58 on pawl 23. The pawl latch plate engaging end surface 54 is held against the pawl unlock surface 59 of latch plate 27 by the return/extension spring 26 and keeping latch plate 27 in a loading ready position. Pawl 23 is attached to the left side hood mounting plate 30 by screws 71*a*, 71*b* through slide pin slots 60*a*, 60*b* which allow pawl 23 to traverse the slots to latch and unlatch latch plate 27. To latch or re-connect the hood, the pivot pin 25 engages into slot 56 of latch plate 27 and slot 35 (not shown) of hood mounting plate 30. This engagement causes latch plate 27 to rotate pushing pawl 23 back causing return/extension spring 26 to load so that it can automatically pull the pawl end 54 into slot 55 locking the pivot pin 25 into mounting plate slot 35 of hood mounting plate 30.

Figure 6:
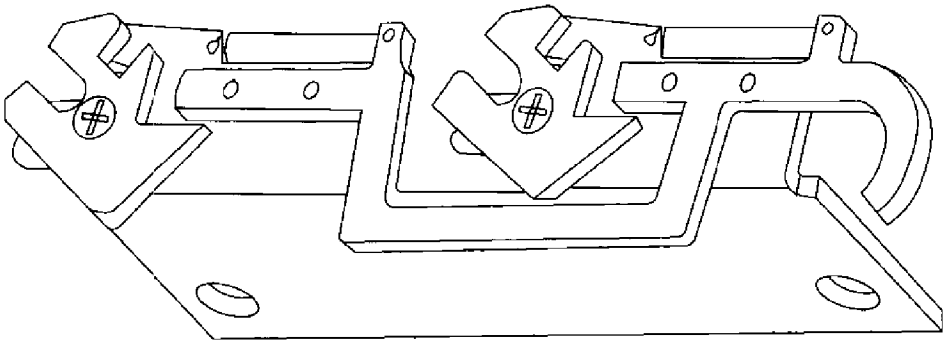
FIG. 6 is a perspective view of a left side hinge assembly for a two-pin combination hood connection.
Figure 7:
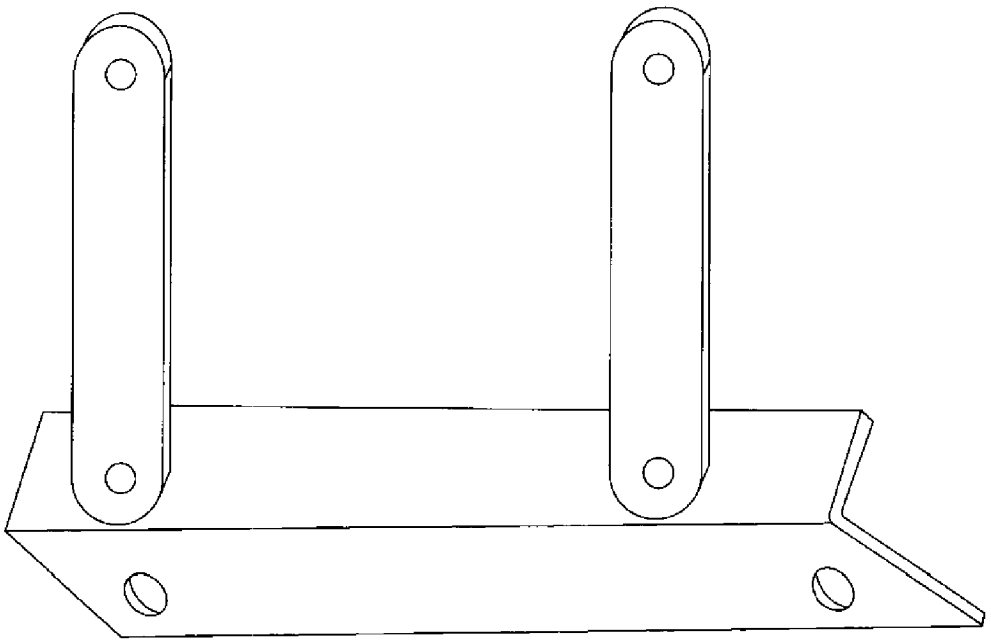
FIG. 7 is a perspective view of a right side hinge assembly for a two-pin combination hood connection.

FIG. 6 is a perspective view of another embodiment of a left side latch assembly. In this embodiment, two latches are provided in a cooperating arrangement for accommodating hinges having a two-pin, compound arrangement or four bar linkage. FIG. 7 is a perspective view of a right side assembly for use with a two-pin, compound arrangement or four bar linkage. The two-pin, compound arrangement is often used when the hood is hinged near the vehicle's firewall instead of near the front of the vehicle.

In this specification, the latch mechanisms are described as being on the left side of the car. The latch mechanisms could alternatively be on the right side, or even both sides. Such arrangements are to be construed as equivalent in this specification and the claims. Although the examples in this specification and drawings show the use of this invention for an automobile hood, the invention is intended to cover all uses of detachable hinges. The invention can be used on covers, doors, suitcases, vehicles, and the like, and any other application requiring a removable hinged member. The use with cars in this specification provides an example of how it is used, but should not be construed as limiting here or in the claims.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A hinge device having means to detach one hinge member from another comprising:

a fender mounting plate having a pivot pin secured thereto;

a hood mounting plate having a pivot pin engaging slot;

an elongated pawl having a latch plate engaging end, the pawl slideably secured to the hood mounting plate; and a latch plate rotatably secured to the hood mounting plate in a spaced relationship with the elongated pawl, the latch plate comprising:

a pawl engaging slot shaped to engage the pawl latch plate engaging end;

a pivot pin engaging slot shaped to engage the pivot pin; and a pawl unlock surface that contacts the latch plate engaging end of the elongated pawl when the elongated pawl is not engaged with the pawl engaging slot;

whereby a user can detach one hinge member from another by withdrawing the pawl, translating one hinge member in relation to the other, thereby rotating the latch plate, which disengages the latch plate and hood mounting plate from the pivot pin and separates the hinge members.

2. The device of claim 1, the latch plate comprising a stop surface for contacting the latch plate engaging end of the elongated pawl and adapted to prevent the latch plate from rotating when the hinge members are detached.

3. The device of claim 2, the latch plate further comprising a stop engaging surface adapted to engage the stop when the hinge members are detached.

4. The device of claim 3, wherein the pawl engaging slot is adjacent to the latch plate pivot pin engaging slot, the latch plate pivot pin engaging slot is adjacent to the stop engaging surface, the stop engaging surface is adjacent to the pawl unlock surface, and the pawl unlock surface is adjacent to the pawl engaging slot.

5. The device of claim 1, further comprising a return spring secured on a spring first end to the pawl and secured on a spring second end to the hood mounting plate, whereby the pawl is pulled Into the pawl engaging slot when the latch plate is rotated into an attached position.

6. The device of claim 1, the pawl further comprising a handle on an end opposite the latch plate engaging end, whereby a user can pull the pawl to disengage the device.

7. The device of claim 1, further comprising a latch plate retaining screw adapted to rotatably secure the latch plate to the hood mounting plate.

8. The device of claim 1,the hood mounting plate comprising a plurality of collinear slots for slidably securing the pawl to the hood mounting plate.

9. The device of claim 8, further comprising pawl mounting screws secured to the pawl corresponding to the hood mounting plate slots.

10. A detachable hood mounting system comprising:

a first side hinge assembly comprising:

a first side hood mounting plate having a first side pivot pin engaging slot;

an elongated pawl having a latch plate engaging end, the pawl slidably secured to the hood mounting plate;

a latch plate rotatably secured to the first side hood mounting plate in a spaced relationship with the pawl, the latch plate comprising:

a pawl engaging slot shaped to engage the pawl latch plate engaging end;

a pivot pin engaging slot shaped to engage a pivot pin; and a pawl unlock surface that contacts the latch plate engaging end when the pawl is not engaged with the slot;

a first side striker pivot pin; and a first side fender mounting plate to which the first side pivot pin is secured; and a second side hinge assembly comprising:

a second side hood mounting plate;

a second side pivot pin; and a second side fender mounting plate.

11. The system of claim 10, the pawl comprising a stop adapted to prevent the latch plate from rotating when the hinge members are detached.

12. The system of claim 11, the latch plate further comprising a stop engaging surface adapted to engage the stop when the hinge members are detached.

13. The system of claim 12, wherein the pawl engaging slot is adjacent to the latch plate pivot pin engaging slot, the latch plate pivot pin engaging slot is adjacent to the stop engaging surface, the stop engaging surface is adjacent to the pawl unlock surface, and the pawl unlock surface is adjacent to the pawl engaging slot.

14. The system of claim 10, further comprising a return spring secured on a spring first end to the pawl and secured on a spring second end to the first side hood mounting plate, whereby the pawl is pulled into the pawl engaging slot when the latch plate is rotated into an attached position.

15. The system of claim 10, the pawl further comprising a handle on an end opposite the latch plate engaging end, whereby a user can pull the pawl to disengage the device.

16. The system of claim 10, further comprising a latch plate retaining screw adapted to rotatably secure the latch plate to the first side hood mounting plate.

17. The system of claim 10, the first side hood mounting plate comprising a plurality of collinear slots for slidably securing the pawl to the first side hood mounting plate.

18. The system of claim 17, further comprising pawl mounting screws secured to the pawl corresponding to the first side hood mounting plate slots.

* * * * *